US006674418B2

(12) United States Patent
Tokunaga et al.

(10) Patent No.: US 6,674,418 B2
(45) Date of Patent: Jan. 6, 2004

(54) METHOD FOR DRIVING A PLASMA DISPLAY PANEL AND A PLASMA DISPLAY APPARATUS THEREFOR

(75) Inventors: Tsutomu Tokunaga, Yamanashi (JP); Mitsushi Kitagawa, Fukuroi (JP)

(73) Assignees: Pioneer Corporation, Tokyo (JP); Shizuoka Pioneer Corporation, Shizuoka (JP)

( * ) Notice: Subject to any disclaimer, the term of this patent is extended or adjusted under 35 U.S.C. 154(b) by 215 days.

(21) Appl. No.: 10/000,963

(22) Filed: Dec. 4, 2001

(65) Prior Publication Data

US 2002/0080097 A1 Jun. 27, 2002

(30) Foreign Application Priority Data

Dec. 6, 2000 (JP) ..... 2000-370988
May 24, 2001 (JP) ..... 2001-155217

(51) Int. Cl.[7] ..... G09G 3/28
(52) U.S. Cl. ..... 345/60; 315/169.1; 315/169.4
(58) Field of Search ..... 345/60, 62, 68, 345/204, 66, 67; 315/169.1, 169.3, 169.4

(56) References Cited

U.S. PATENT DOCUMENTS 5,943,031 A * 8/1999 Tokunaga et al. ..... 345/60
6,414,653 B1 * 7/2002 Kobayashi ..... 345/60
2002/0195963 A1 * 12/2002 Tokunaga et al. ..... 315/169.3
2003/0011540 A1 * 1/2003 Tokunaga et al. ..... 345/60
2003/0011541 A1 * 1/2003 Tokunaga et al. ..... 345/60

* cited by examiner

*Primary Examiner*—Amare Mengistu
(74) *Attorney, Agent, or Firm*—Sughrue Mion, PLLC

(57) ABSTRACT

A method for driving a PDP which can realize higher image quality and lower costs and a plasma display apparatus therefor are provided. A pulse having an interval during which a pulse voltage changes gradually and another interval during which the pulse voltage changes steeply is generated as a reset pulse applied for allowing a discharge cell of the PDP to reset-discharge. In this instance, in the interval during which the pulse voltage changes gradually, a voltage applied to the discharge cell is allowed to reach a minimum reset-discharge starting voltage.

12 Claims, 10 Drawing Sheets

METHOD FOR DRIVING A PLASMA DISPLAY PANEL AND A PLASMA DISPLAY APPARATUS THEREFOR

BACKGROUND OF THE INVENTION

1. Field of the Invention

The invention relates to a plasma display apparatus having a plasma display panel.

2. Description of the Related Art

In recent years, a thin type display device has been requested associated by the realization of a large screen of a display apparatus and various thin type display devices have been put into practical use. Attention is paid to a plasma display panel of an AC discharge type as one of the thin type display devices.

FIG. 1 is a diagram showing a construction of a plasma display apparatus having a plasma display panel (designated as a PDP hereinafter).

In FIG. 1, a PDP 10 comprises: m column electrodes $D_1$ to $D_m$; and n row electrodes $X_1$ to $X_n$ and n row electrodes $Y_1$ to $Y_n$ which are arranged so as to cross the column electrodes, respectively. With respect to the row electrodes $X_1$ to $X_n$ and the row electrodes $Y_1$ to $Y_n$, first to nth display lines in the PDP 10 are constructed by pairs of row electrodes $X_i$ ($1 \leqq i \leqq n$) and $Y_i$ ($1 \leqq i \leqq n$). A discharge space filled with discharge gas is formed between the column electrode D and the row electrodes X and Y. The discharge space has a structure such that a discharge cell serving as a display pixel is formed at a crossing portion of each row electrode pair and the column electrode.

Each discharge cell has only two states of "light emission" and "non-light emission" because a light emission is performed by using a discharge phenomenon. That is, only luminance of two gradations of the lowest luminance (non-light emitting state) and the highest luminance (light emitting state) is realized.

A driving apparatus 100, therefore, executes a gradation driving using a subfield method in order to allow the PDP 10 to realize a luminance display of a halftone corresponding to a supplied video signal. As subfield methods, there are a selective erasure address method and a selective write address method. According to the selective erasure address method, wall charges are previously formed in all discharge cells (all-resetting step Rc) and the wall charges in each discharge cell are selectively erased in response to an input video signal (pixel data writing step Wc). According to the selective write address method, wall charges in all discharge cells are previously extinguished (all-resetting step Rc) and the wall charges are selectively formed in each discharge cell in response to an input video signal (pixel data writing step Wc).

In the subfield method, the supplied video signal is converted into pixel data of, for example, 4 bits corresponding to each pixel and one field is divided into four subfields SF1 to SF4 as shown in FIG. 2 in correspondence to each bit digit of the 4 bits. At this time, as shown in FIG. 2, the number of executing times of light emission corresponding to a weight of the pixel data bits is allocated to each of the subfields SF1 to SF4. The discharge cells are light-emitted every subfield in accordance with a logic level of the pixel data bit corresponding to the subfield.

FIG. 3 is a diagram showing various kinds of driving pulses which are applied to the row electrode pairs and the column electrodes of the PDP 10 in one subfield in order to drive the driving apparatus 100 by, for example, the selective erasure address method and showing timing for applying those pulses.

First, in the all-resetting step Rc, the driving apparatus 100 applies a reset pulse $RP_x$ of a negative polarity whose trailing change is mild and which is shown in FIG. 3 all at once to each of the row electrodes $X_1$ to $X_n$. The driving apparatus 100, further, applies a reset pulse $RP_Y$, of a positive polarity whose leading change is mild and which is shown in FIG. 3 all at once to each of the row electrodes $Y_1$ to $Y_n$ simultaneously with the application of the reset pulse $PR_X$. In accordance with the application of the reset pulses $RP_X$ and $RP_Y$, all of the discharge cells of the PDP 10 are discharged for resetting. After termination of the reset discharge, wall charges of a predetermined amount are uniformly formed in each discharge cell and the formed wall charges are held.

By the execution of the all-resetting step Rc, all of the discharge cells in the PDP 10 are initialized to a state where a light emission (sustaining discharge) is possible (hereinafter, referred to as a "light emitting cell" state) in a light emission sustaining step Ic, which will be explained hereinlater.

In the pixel data writing step Wc, the driving apparatus 100 separates each bit of the pixel data of 4 bits in correspondence to each of the subfields SF1 to SF4 and generates a pixel data pulse having a pulse voltage according to a logic level of the bit. For example, in the pixel data writing step Wc of the subfield SF1, the driving apparatus 100 generates the pixel data pulse having the pulse voltage according to the logic level of the first bit of the pixel data. At this time, the driving apparatus 100 generates the pixel data pulse having the pulse voltage of a high voltage if the logic level of the first bit is equal to "1" and generates the pixel data pulse having the pulse voltage of a low voltage (0 volt) if the logic level of the first bit is equal to "0". The driving apparatus 100 sequentially applies the pixel data pulses as pixel data pulse groups $DP_1$ to $DP_n$ as many as each display line corresponding to each of the first to nth display lines to the column electrodes $D_1$ to $D_M$ as shown in FIG. 3. The driving apparatus 100, further, generates a scanning pulse SP of a negative polarity as shown in FIG. 3 synchronously with the applying timing of each of the pixel data pulse groups DP and sequentially applies the scanning pulse to the row electrodes $Y_1$ to $Y_n$. At this time, a discharge (selective erasure discharge) is caused only in the discharge cell at the crossing portion of the display line to which the scanning pulse SP has been applied and the "column" to which the pixel data pulse of the high voltage has been applied. By the selective erasure discharge, the wall charges held in the discharge cell are extinguished. That is, the discharge cell is shifted to a state where the light emission (sustaining discharge) is impossible (hereinafter, referred to as a "non-light emitting cell" state) in the light emission sustaining step Ic, which will be explained hereinlater. The selective erasure discharge is not caused in the discharge cell to which the pixel data pulse of the low voltage has been applied although the scanning pulse SP was applied. That is, the discharge cell sustains the state where it has been initialized in the all-resetting step Rc, that is, the "light emitting cell" state.

That is, according to the pixel data writing step Wc, each discharge cell of the PDP 10 is set to either the "light emitting cell" state or the "non-light emitting cell" state in accordance with the pixel data based on the input video signal.

Subsequently, in the light emission sustaining step Ic, the driving apparatus 100 alternately and repetitively applies a sustaining pulse $IP_X$ of a positive polarity and a sustaining pulse $IP_Y$ of a positive polarity to the row electrodes $X_1$ to $X_n$ and the row electrodes $Y_1$ to $Y_n$ as shown in FIG. 3. In one subfield, the number of times (period) of applying the sustaining pulses $IP_X$ and $IP_Y$ is set in accordance with a weight of each subfield as shown in FIG. 2. Only the discharge cell in which the wall charges exist, namely, only the discharge cell in the "light emitting cell" state discharges for the sustaining light emission each time the sustaining pulses $IP_X$ and $IP_Y$ are applied. That is, only the discharge cell set to the "light emitting cell" state in the pixel data writing step Wc repeats the light emission associated by the sustaining discharge the number of times set in correspondence to the weight of each subfield as shown in FIG. 2 and sustains the light emitting state.

The driving apparatus 100 executes the above operation every subfield. In this instance, a luminance of the halftone corresponding to the video signal is expressed by the total number (in one field) of light emissions associated by the sustaining discharge caused in each subfield. That is, the image display corresponding to the video signal is performed by the light emission caused by the sustaining discharge.

To perform the image display by using a discharge phenomenon, however, a discharge which causes a light emission that is not concerned with the display image has to be also caused. Particularly, since all of the discharge cells perform the light emission all at once by a reset discharge which is caused in the all-resetting step Rc, a problem such that a decrease in contrast appears typically when an image of a low luminance is displayed occurs. To prevent the problem, as shown in FIG. 3, each of the trailing change of the reset pulse $RP_x$ which is applied to cause the reset discharge and the leading change of the reset pulse $RP_Y$ which is also applied is set to be mild. Although the amount of light emission associated by the reset discharge consequently decreases, an amount of wall charges and priming particles which are formed also decreases. At this time, in order to form a desired amount of wall charges and priming particles, it is necessary to increase pulse voltages (VR, −VR) of the reset pulses ($RP_Y$ and $RP_X$) and, further, widen a pulse width ($T_R$) of each of them. A driver of a high withstanding voltage, therefore, is used as a driver for generating the reset pulses, resulting in an increase in costs. Further, if the pulse width of the reset pulse is widened, since a time which is necessary for the all-resetting step Rc becomes long, a time which is necessary for the pixel data writing step Wc and the light emission sustaining step Ic has to be shortened by the duration corresponding to it. An erroneous discharge, however, occurs if the pulse width of each of the pixel data pulse and the scanning pulse SP is narrowed in order to shorten the time which is necessary for the pixel data writing step Wc. The luminance of the whole picture plane decreases if the number of executing times of the sustaining discharge is decreased in order to shorten the time which is necessary for the light emission sustaining step Ic. That is, a problem of deterioration of the picture quality is caused.

OBJECTS AND SUMMARY OF THE INVENTION

The invention is made to overcome the above problems. An object of the invention is to provide a method for driving a PDP and a plasma display apparatus which can realize high picture quality and low costs.

According to a fist aspect of the invention, we provide a method for driving a PDP in accordance with video signals, said PDP including a plurality of discharge cells arranged in a matrix form, each of said discharge cells working as a display pixel. The method comprises the steps of: applying a reset pulse to all of said discharge cells to cause all of said discharge cells to discharge for resetting all of said discharge cells; applying a scanning pulse to each of said discharge cells to cause each of said discharge cells to selective-discharge for selecting either of light-emission and non-light-emission modes for each of said discharge cells on the basis of pixel data corresponding to a video signal for each of said discharge cells; and applying a sustaining pulse to allow only the discharge cell in the light-emission mode to discharge for repeating light emission. The reset pulse comprises a first pulse voltage shift interval in which a pulse voltage changes gradually, reaches a minimum reset-discharge starting voltage, and exceeds the minimum reset-discharge starting voltage, and a second pulse voltage shift interval in which said pulse voltage changes steeply.

According to a second aspect of the invention, we provides a method for driving a PDP in accordance with video signals, said PDP including a plurality of discharge cells arranged in a matrix form, each of said discharge cells working as a display pixel. The method comprises the steps of: applying a reset pulse to all of said discharge cells to cause all of said discharge cells to discharge for resetting all of said discharge cells; applying a scanning pulse to each of said discharge cells to cause each of said discharge cells to selective-discharge for selecting either of light-emission and non-light-emission modes for each of said discharge cells on the basis of pixel data corresponding to a video signal for each of said discharge cells; and applying a sustaining pulse to allow only the discharge cell in the light-emission mode to discharge for repeating light emission. The reset pulse comprises a first pulse voltage shift interval in which a pulse voltage changes steeply, and a second pulse voltage shift interval during which said pulse voltage changes gradually, reaches a minimum reset-discharge starting voltage, and exceeds the minimum reset-discharge starting voltage.

According to a third aspect of the invention, we provide a method for driving a PDP in accordance with video signals, said PDP including a plurality of discharge cells arranged in a matrix form, each of said discharge cells working as a display pixel. The apparatus comprises the steps of: applying a reset pulse to all of said discharge cells to cause all of said discharge cells to discharge for resetting all of said discharge cells; applying a scanning pulse to each of said discharge cells to cause each of said discharge cells to selective-discharge for selecting either of light-emission and non-light-emission modes for each of said discharge cells on the basis of pixel data corresponding to a video signal for each of said discharge cells; and applying a sustaining pulse to allow only the discharge cell in the light-emission mode to discharge for repeating light emission. The reset pulse comprises a first pulse voltage shift interval during which a pulse voltage changes steeply, a second pulse voltage shift interval during which said pulse voltage changes gradually, reaches a minimum reset-discharge starting voltage, and exceeds the minimum reset-discharge starting voltage, and a third pulse voltage shift interval during which said pulse voltage changes steeply.

According to a forth aspect of the invention, we provide an apparatus for driving a PDP in accordance with video signals, said PDP comprising a plurality of discharge cells arranged in a matrix form, each of said discharge cells working as a display pixel. The apparatus further comprises: a reset pulse generator for generating a reset pulse for causing each of said discharge cells to discharge and applying said reset pulse to all of said discharge cells, thereby resetting all of said discharge cells; a scanning pulse generator for generating a scanning pulse for causing each of said discharge cells to selective-discharge for selecting either of light-emission and non-light emission modes for each of said discharge cells in accordance with pixel data corresponding to a video signal for said each of discharge cells, and applying said scanning pulse to said each of discharge cells; and a sustaining pulse generator for generating a sustaining pulse to allow only the discharge cell in the light-emission mode to discharge for repeating light emission. The reset pulse comprises a first pulse voltage shift interval during which a pulse voltage changes gradually, reaches a minimum reset-discharge starting voltage, and exceeds said minimum reset-discharge starting voltage, and a second pulse voltage shift interval during which said pulse voltage changes steeply.

According to a fifth aspect of the invention, we provide an apparatus for driving a PDP in accordance with video signals, said PDP comprising a plurality of discharge cells arranged in a matrix form, each of said discharge cells working as display pixels. The apparatus further comprises: a reset pulse generator for generating a reset pulse for causing each of said discharge cells to discharge and applying said reset pulse to all of said discharge cells, thereby resetting all of said discharge cells; a scanning pulse generator for generating a scanning pulse for causing each of said discharge cells to selective-discharge for selecting either of light-emission and non-light emission modes for each of said discharge cells in accordance with pixel data corresponding to a video signal for said each of discharge cells, and applying said scanning pulse to said each of discharge cells; and a sustaining pulse generator for generating a sustaining pulse to allow only the discharge cell in the light-emission mode to discharge for repeating light emission. The reset pulse comprises a first pulse voltage shift interval during which a pulse voltage changes steeply, and a second pulse voltage shift interval during which said pulse voltage changes gradually, reaches a minimum reset-discharge starting voltage, and exceeds the minimum reset-discharge starting voltage.

According to a sixth aspect of the invention, we provide an apparatus for driving a PDP in accordance with video signals, said PDP comprising a plurality of discharge cells arranged in a matrix form, each of said discharge cells working as a display pixel. The apparatus further comprises: a reset pulse generator for generating a reset pulse for causing each of said discharge cells to discharge and applying said reset pulse to all of said discharge cells, thereby resetting all of said discharge cells; a scanning pulse generator for generating a scanning pulse for causing each of said discharge cells to selective-discharge for selecting either of light-emission and non-light emission modes for each of said discharge cells in accordance with pixel data corresponding to a video signal for said each of discharge cells, and applying said scanning pulse to said each of discharge cells; and a sustaining pulse generator for generating a sustaining pulse to allow only the discharge cell in the light-emission mode to discharge for repeating light emission. The reset pulse comprises a first pulse voltage shift interval during which a pulse voltage changes steeply, a second pulse voltage shift interval during which said pulse voltage changes gradually, reaches a minimum reset-discharge starting voltage, and exceeds said minimum reset-discharge starting voltage, and a third pulse voltage shift interval during which the pulse voltage changes steeply.

As mentioned above, according to the driving method of the PDP of the invention, the pulse comprising the interval where the pulse voltage is gradually shifted and the interval where it is steeply shifted is generated as a reset pulse which is applied for allowing the discharge cells of the PDP to be reset-discharged. In the invention, in the interval where the pulse voltage is gradually shifted, the pulse voltage is allowed to reach the minimum reset discharge starting voltage. Although the weak reset discharge of the low light emission luminance is, consequently, caused within the relatively short period of time, the applied voltage and the time which are necessary for forming the wall charges can be obtained.

According to the invention, therefore, since the desired amount of wall charges can be formed in each discharge cell without needing to increase the pulse voltage and pulse width of the reset pulse, the relatively cheap driver of a low withstanding voltage can be used as a driver for generating the reset pulse. Further, since the pulse width of the reset pulse can be narrowed more than that of the conventional pulse, the time which is used for the pixel data writing step and the light emission sustaining step can be extended by the time corresponding to it and the high picture quality can be realized.

BRIEF DESCRIPTION OF THE DRAWINGS

The aforementioned aspects and other features of the invention are explained in the following description, taken in connection with the accompanying drawing figures wherein.

DETAILED DESCRIPTION OF THE PREFERRED EMBODIMENTS

Preferred embodiments of the invention will be described in detail hereinbelow with reference to the drawings.

Figure 4:
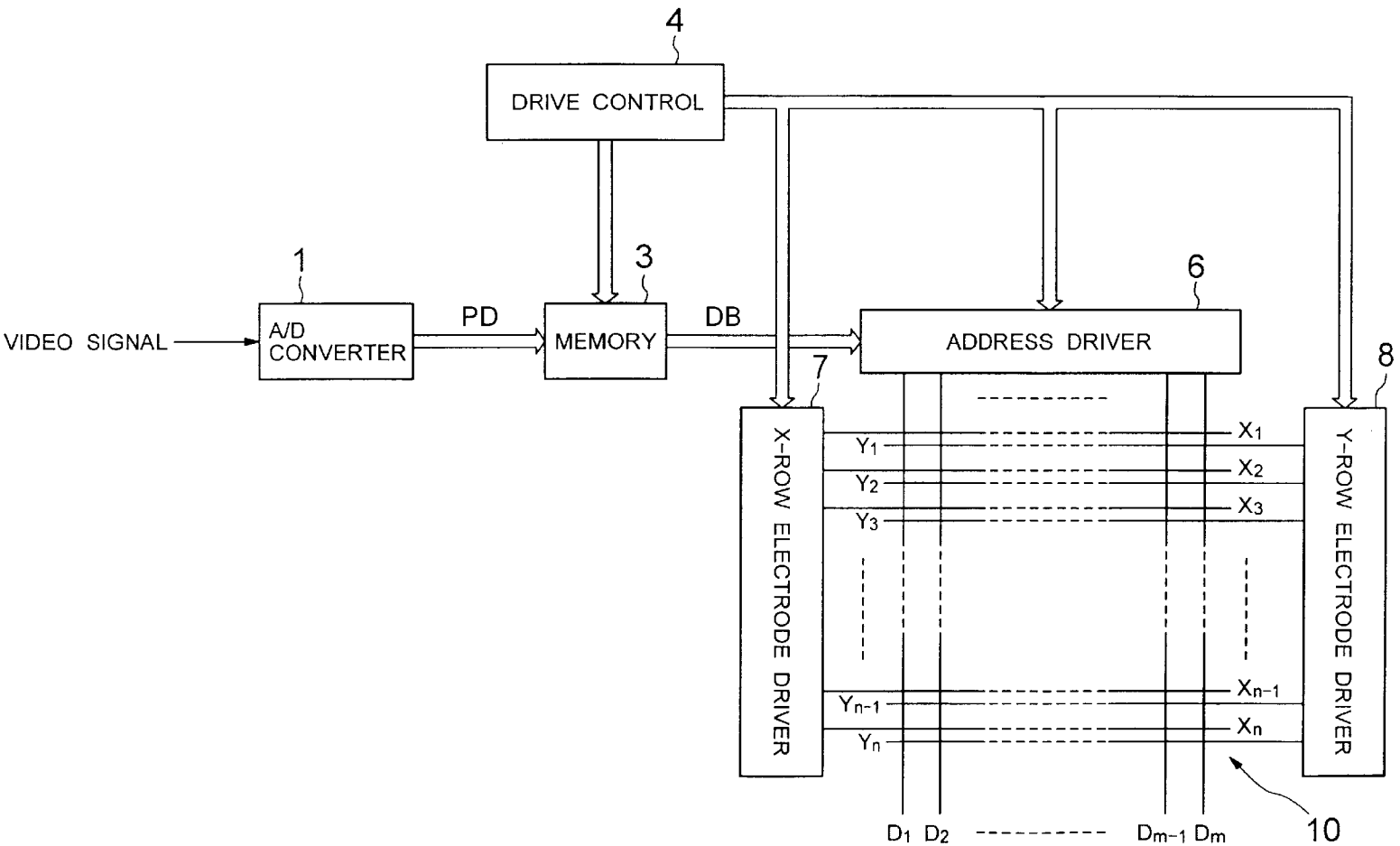
FIG. 4 is a diagram showing a construction of a plasma display apparatus for driving a PDP by a driving method according to the invention.

FIG. 4 is a diagram showing a construction of a plasma display apparatus for driving a PDP by a driving method according to the invention.

In FIG. 4, a PDP 10 as a PDP comprises: m column electrodes $D_1$ to $D_m$; and n row electrodes $X_1$ to $X_n$ and n row electrodes $Y_1$ to $Y_n$ which are arranged so as to cross the column electrodes, respectively. With respect to the row electrodes $X_1$ to $X_n$ and the row electrodes $Y_1$ to $Y_n$, the first to nth display lines in the PDP 10 are constructed by pairs of row electrodes $X_i$ ($1 \leqq i \leqq n$) and $Y_i$ ($1 \leqq i \leqq n$). A discharge space filled with discharge gas is formed between the column electrode D and the row electrodes X and Y. The discharge space has a structure such that a discharge cell serving as a display pixel is formed at each crossing portion of the row electrode pair and the column electrode including the discharge space. The discharge cells are arranged in a matrix form.

An A/D converter 1 samples the supplied video signal and converts the sampled video signal to pixel data PD of N bits showing a luminance level of each pixel.

The pixel data PD is sequentially written into a memory 3 in response to a write signal supplied from a drive control circuit 4. After completion of the writing of the (n×m) pixel data PD of one frame, that is, the pixel data in a range from the pixel data $PD_{11}$ corresponding to the pixel of the first row and the first column to the pixel data $PD_{nm}$ corresponding to the pixel of the nth row and the mth column, the following reading operation of the memory 3 is executed. First, the memory 3 captures the data of the first bit of each of the pixel data $PD_{11}$ to $PD_{nm}$ as pixel driving data bits $DB1_{11}$ to $DB1_{nm}$, reads them out by every amount corresponding to one display line in accordance with a read address supplied from the drive control circuit 4, and supplies them to an address driver 6. The memory 3 subsequently captures the data of the second bit of each of the pixel data $PD_{11}$ to $PD_{nm}$ as pixel driving data bits $DB2_{11}$ to $DB2_{nm}$, reads them out by every amount corresponding to one display line in accordance with the read address supplied from the drive control circuit 4, and supplies them to the address driver 6. In a manner similar to that mentioned above, the memory 3 captures the data of the third to Nth bits of each of the pixel data $PD_{11}$ to $PD_{nm}$ as pixel driving data bits DB3 to DB(N), reads them out every DB by every amount corresponding to one display line, and supplies them to the address driver 6.

Figure 5:
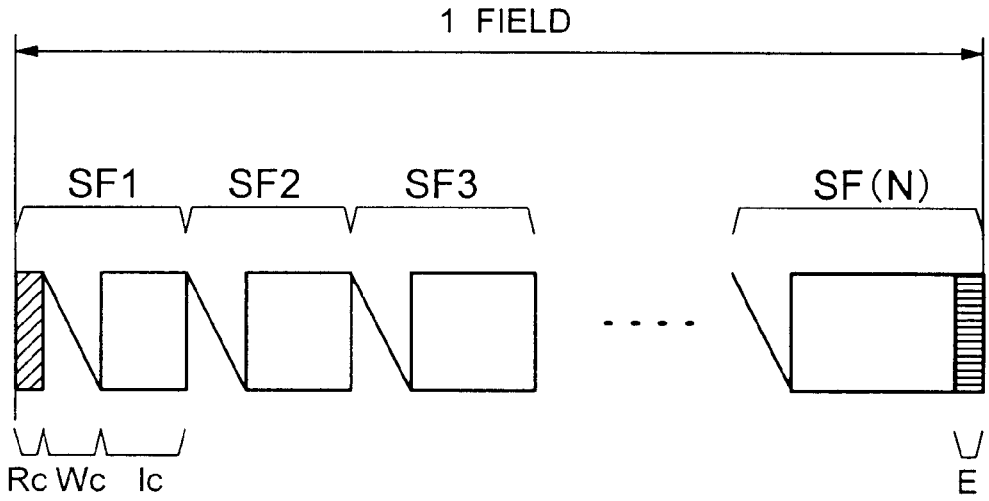
FIG. 5 is a diagram showing an example of a light emission driving format which is used in the plasma display apparatus shown in FIG. 4.

The drive control circuit 4 generates various switching signals for gradation-driving the PDP 10 in accordance with a light emission driving format shown in FIG. 5, and supplies them to the address driver 6, an X-row electrode driver 7, and a Y-row electrode driver 8. For example, in the light emission driving format shown in FIG. 5, a display period of one field is divided into N subfields $SF_1$ to $SF_N$. Each of the pixel data writing step Wc and the light emission sustaining step Ic as mentioned above is executed in each subfield. Further, the all-resetting step Rc is executed only in the head subfield SF1. An erasing step E for extinguishing the wall charges remaining in each discharge cell is executed only in the last subfield $SF_N$.

Figure 6:
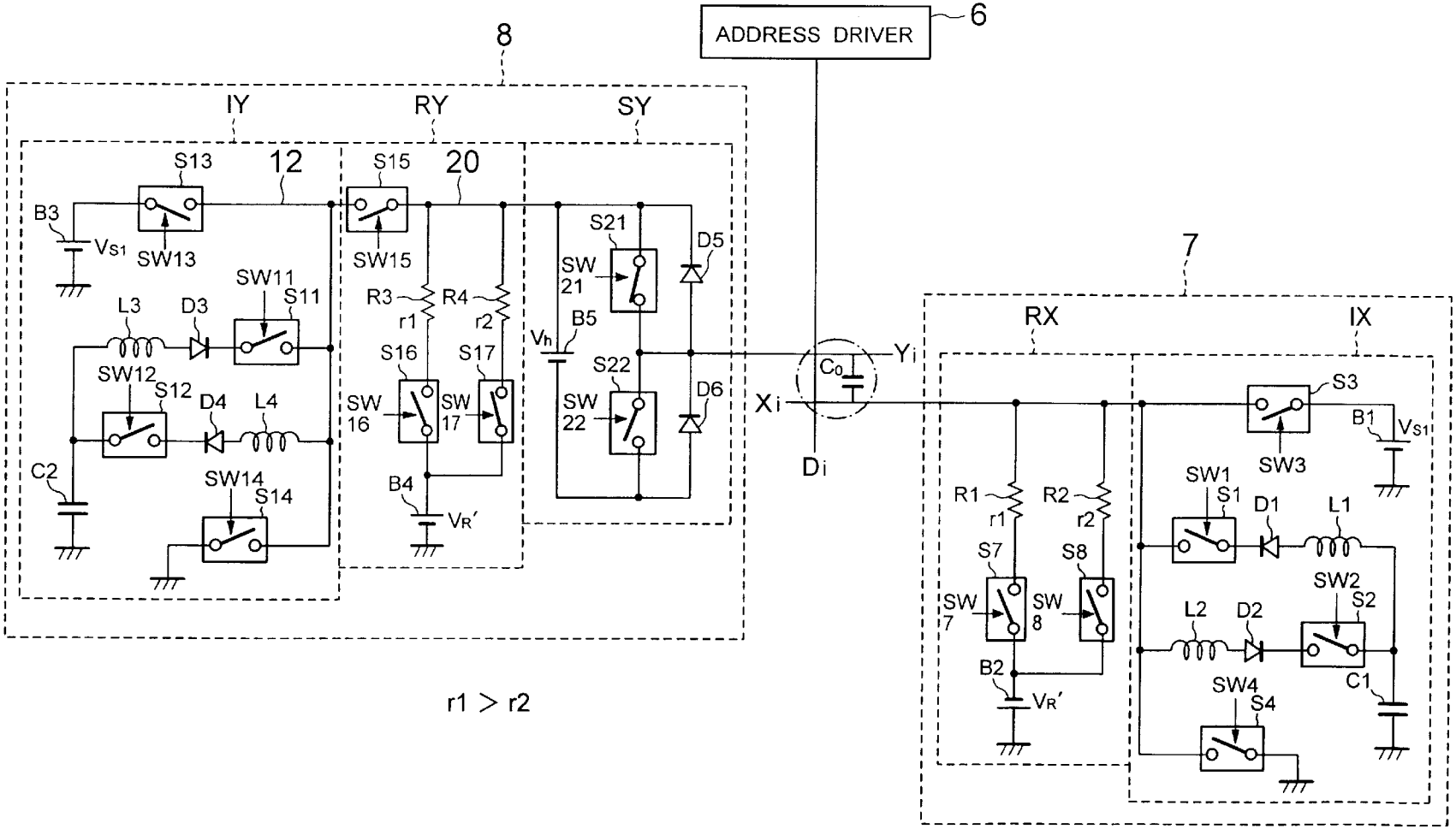
FIG. 6 is a diagram showing an internal construction of an X-row electrode driver 7 and a Y-row electrode driver 8.

FIG. 6 is a diagram showing an internal construction of the X-row electrode driver 7 and Y-row electrode driver 8.

As shown in FIG. 6, the X-row electrode driver 7 comprises a reset pulse generating circuit RX for generating a reset pulse $RP_x'$, and a sustaining pulse generating circuit IX for generating the sustaining pulse $IP_X$.

The sustaining pulse generating circuit IX comprises: a DC power source B1 for generating a DC voltage $V_{S1}$: switching devices S1 to S4; coils L1 and L2; diodes D1 and D2; and a capacitor C1. The switching device S1 is turned on only for a period of time during which a switching signal SW1 supplied from the drive control circuit 4 is at the logic level "1", thereby allowing an electric potential on one end of the capacitor C1 to be applied to the row electrode X through the coil L1 and diode D1. The switching device S2 is turned on only for a period of time during which a switching signal SW2 supplied from the drive control circuit 4 is at the logic level "1", thereby allowing the electric potential on the row electrode X to be applied to one end of the capacitor C1 through the coil L2 and diode D2. The switching device S3 is turned on only for a period of time during which a switching signal SW3 supplied from the drive control circuit 4 is at the logic level "1", thereby allowing the voltage $V_{S1}$ generated from the DC power source B1 to be applied to the row electrode X. The switching device S4 is turned on only for a period of time during which a switching signal SW4 supplied from the drive control circuit 4 is at the logic level "1", thereby connecting the row electrode X to the ground.

The reset pulse generating circuit RX comprises: a DC power source B2 for generating a DC voltage $V_R'$; switching devices S7 and S8; and resistors R1 and R2. A resistance r1 of the resistor R1 is larger than a resistance r2 of the resistor R2. A positive side terminal of the DC power source B2 is connected to the ground and its negative side terminal is connected to each of the switching devices S7 and S8. The switching device S7 is turned on only for a period of time during which a switching signal SW7 supplied from the drive control circuit 4 is at the logic level "1", thereby allowing a voltage $-V_R'$ as a negative side terminal voltage of the DC power source B2 to be applied to the row electrode X through the resistor R1. The switching device S8 is turned on only for a period of time during which a switching signal SW8 supplied from the drive control circuit 4 is at the logic level "1", thereby allowing the voltage $-V_R'$ as a negative side terminal voltage of the DC power source B2 to be applied to the row electrode X through the resistor R2.

The Y-row electrode driver 8 comprises a reset pulse generating circuit RY for generating a reset pulse $RP_Y'$, a scanning pulse generating circuit SY for generating a scanning pulse SP, and a sustaining pulse generating circuit IY for generating the sustaining pulse $IP_Y$.

The reset pulse generating circuit RY comprises: a DC power source B4 for generating the DC voltage $V_R'$; switching devices S15 to S17; and resistors R3 and R4. A resistance value r1 of the resistor R3 is larger than a resistance value r2 of the resistor R4. A negative side terminal of the DC power source B4 is connected to the ground, and its positive side terminal is connected to each of the switching devices S16 and S17. The switching device S16 is turned on only for a period of time during which a switching signal SW16 supplied from the drive control circuit 4 is at the logic level "1", thereby allowing the voltage $V_R'$ as a positive side terminal voltage of the DC power source B4 to be applied onto a line 20 through the resistor R3. The switching device S17 is turned on only for a period of time during which a switching signal SW17 supplied from the drive control circuit 4 is at the logic level "1", thereby allowing the voltage $V_R'$ as a positive side terminal voltage of the DC power source B4 to be applied onto the line 20 through the resistor R4. The switching device S15 is turned on only for a period of time during which a switching signal SW15 supplied from the drive control circuit 4 is at the logic level "1", thereby allowing the line 20 to be connected to a line 12, which will be explained hereinlater.

The sustaining pulse generating circuit IY comprises: a DC power source B3 for generating the DC voltage $V_{S1}$; switching devices S11 to S14; coils L3 and L4; diodes D3 and D4; and a capacitor C2. The switching device S11 is turned on only for a period of time during which a switching signal SW11 supplied from the drive control circuit 4 is at the logic level "1", thereby allowing an electric potential on one end of the capacitor C2 to be applied onto the line 12 through the coil L3 and diode D3. The switching device S12 is turned on only for a period of time during which a switching signal SW12 supplied from the drive control circuit 4 is at the logic level "1", thereby allowing the electric potential on the line 12 to be applied to one end of the capacitor C2 through the coil L4 and diode D4. The switching device S13 is turned on only for a period of time during which a switching signal SW13 supplied from the drive control circuit 4 is at the logic level "1", thereby allowing the voltage $V_{S1}$ generated from the DC power source B3 to be applied onto the line 12. The switching device S14 is turned on only for a period of time during which a switching signal SW14 supplied from the drive control circuit 4 is at the logic level "1", thereby connecting the line 12 to the ground.

The scanning pulse generating circuit SY is actually provided for each of the row electrodes $Y_1$ to $Y_n$. The scanning pulse generating circuit SY comprises: a DC power source B5 for generating a DC voltage $V_h$; switching devices S21 and S22; and diodes D5 and D6. The switching device S21 is turned on only for a period of time during which a switching signal SW21 supplied from the drive control circuit 4 is at the logic level "1", thereby allowing a positive side terminal of the DC power source B5 to be connected to the row electrode Y and a cathode terminal of the diode D6, respectively. The switching device S22 is turned on only for a period of time during which a switching signal SW22 supplied from the drive control circuit 4 is at the logic level "1", thereby allowing a negative side terminal of the DC power source B5 to be connected to the row electrode Y and an anode terminal of the diode D5, respectively.

Figure 7:
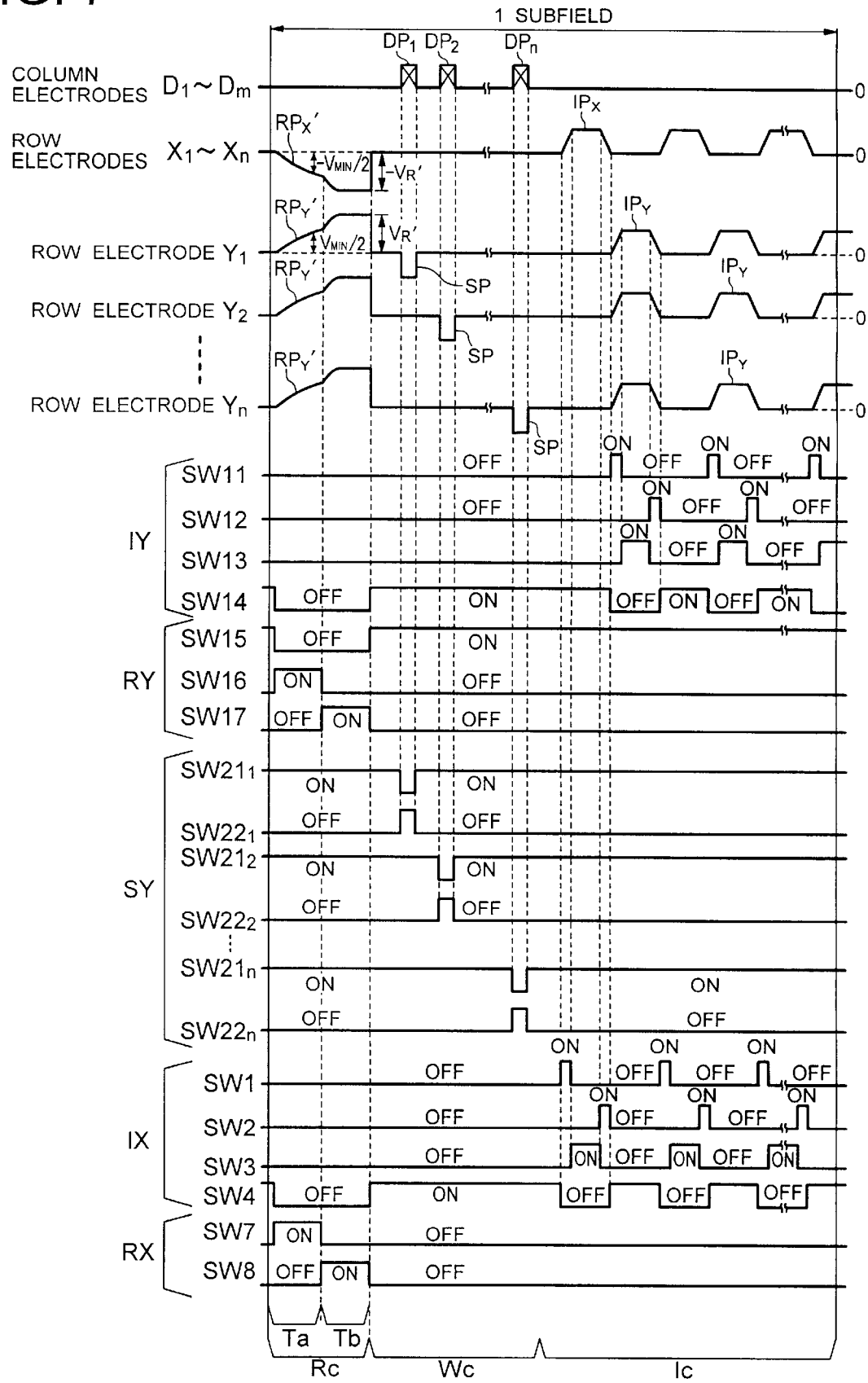
FIG. 7 is a diagram showing various kinds of driving pulses which are generated in response to a switching signal SW by a selective erasure address method and timing for applying those pulses.

FIG. 7 shows various driving pulses which are applied to the PDP 10 and their applying timing in the case where in the subfield SF1 shown in FIG. 5, the address driver 6, X-row electrode driver 7, and Y-row electrode driver 8 use a selective erasure address method.

In the all-resetting step Rc, the drive control circuit 4 supplies the switching signals SW7 and SW8 which change as shown in FIG. 7 to the reset pulse generating circuit RX. That is, first, the drive control circuit 4 maintains supplying the switching signal SW7 at the logic level "1" and the switching signal SW8 at the logic level "0" to the reset pulse generating circuit RX for a time of 20 [μsec] or longer (a first pulse voltage shift interval Ta). Only the switching device S7 between the switching devices S7 and S8 is, thus, turned on, and the voltage $-V_R'$ as a negative side terminal voltage of the DC power source B2 is applied to the row electrode X through the resistor R1. At this time, since a load capacitance C0 exists between the row electrodes X and Y, the voltage on the row electrode X gradually drops as shown in FIG. 7. That is, in the first pulse voltage shift interval Ta, after the elapse of a time of about 20 [μsec] after the voltage on the row electrode X started to gradually drop, the pulse voltage reaches a voltage ($-V_{MIN}>-V_R'$) of ½ of a minimum reset discharge starting voltage—$V_{MIN}$ and falls below the minimum reset discharge starting voltage. At this time, the drive control circuit 4 switches the switching signal SW7 to the logic level "0" and switches the switching signal SW8 to the logic level "1," (a second pulse voltage shift interval Tb). Only the switching device S8 between the switching devices S7 and S8 is, thus, turned on, and the voltage $-V_R'$ as a negative side terminal voltage of the DC power source B2 is applied to the row electrode X through the resistor R2. At this time, since the resistance value r2 of the resistor R2 is smaller than the resistance value r1 of the resistor R1, the voltage steeply drops and reaches the voltage $-V_R'$ as shown in FIG. 7.

By the above operation, the X-row electrode driver 7 applies the reset pulse $RP_X'$ of the negative polarity having the waveform as shown in FIG. 7 all at once to each of the row electrodes $X_1$ to $X_n$. That is, as shown in FIG. 7, first, the X-row electrode driver 7 applies the reset pulse $RP_X'$ to the row electrodes $X_1$ to $X_n$. The reset pulse $RP_X'$ has a voltage which gradually drops, reaches the voltage of ½ of the minimum reset discharge starting voltage $-V_{MIN}$, and falls below the minimum reset discharge starting voltage $-V_{MIN}$ during the first pulse voltage shift interval Ta, and then steeply drops and reaches the pulse voltage $-V_R'$ during the second pulse voltage shift interval Tb. In the all-resetting step Rc, a period of time until the pixel data writing step Wc is started after the second pulse voltage shift interval Tb becomes a shift interval Tr.

Further, in the all-resetting step Rc, the drive control circuit 4 supplies the switching signal SW21 at the logic level "1" and the switching signal SW22 at the logic level "0" to the scanning pulse generating circuit SY. The switching device S21 is, thus, turned on and the electric potential on the line 20 is applied to the row electrode Y. Further, in the all-resetting step Rc, the drive control circuit 4 supplies the switching signals SW16 and SW17, which change as shown in FIG. 7, to the reset pulse generating circuit RY. That is, first, the drive control circuit 4 maintains supplying the switching signal SW16 at the logic level "1" and the switching signal SW17 at the logic level "0" to the reset pulse generating circuit RY for a time of 20 [μsec] or longer (the first pulse voltage shift interval Ta). Only the switching device S16 between the switching devices S16 and S17 is, thus, turned on and the voltage $V_R'$ as a positive side terminal voltage of the DC power source B4 is applied to the row electrode Y through the resistor R3 and line 20. At this time, since the load capacitance C0 exists between the row electrodes X and Y, the voltage on the row electrode Y gradually rises as shown in FIG. 7. That is, in the first pulse voltage shift interval Ta, after the elapse of a time of about 20 [μsec] after the voltage on the row electrode Y started to rise, the pulse voltage reaches a voltage of ½ of a minimum reset discharge starting voltage $V_{MIN}$ ($V_{MIN}<VR_R'$), and increases above the voltage of ½ of a minimum reset discharge starting voltage $V_{MIN}$. At this time, the drive control circuit 4 switches the switching signal SW16 to the logic level "0" and switches the switching signal SW17 to the logic level "1" (the second pulse voltage shift interval Tb). Only the switching device S17 between the switching devices S16 and S17 is, thus, turned on and the voltage $V_R'$ as a positive side terminal voltage of the DC power source B4 is applied to the row electrode Y through the resistor R4 and line 20. Since the resistance value r2 of the resistor R4 is smaller than the resistance value r1 of the resistor R3, the voltage steeply rises more than that of the first pulse voltage shift interval Ta, and reaches the voltage $V_R'$ as shown in FIG. 7.

By the above operation, the Y-row electrode driver 8 applies the reset pulse $RP_Y'$ of the positive polarity having the waveform as shown in FIG. 7 all at once to each of the row electrodes $Y_1$ to $Y_n$ simultaneously with the application of the reset pulse $RP_X'$. That is, as shown in FIG. 7, first, the Y-row electrode driver 8 applies the reset pulse $RP_Y'$ to the row electrodes $Y_1$ to $Y_n$. The reset pulse $RP_Y'$ has a voltage which gradually rises, reaches the voltage of ½ of the minimum reset discharge starting voltage $V_{MIN}$, and increases above the voltage of ½ of the minimum reset discharge starting voltage $V_{MIN}$ during the first pulse voltage shift interval Ta), and then steeply rises and reaches the voltage $V_R'$ during the second pulse voltage shift interval Tb.

In accordance with the application of the reset pulses $RP_X'$ and $RP_Y'$, in all of the discharge cells of the PDP 10, a weak reset discharge is intermittently caused at timing when an electric potential difference between the row electrodes X and Y serving as a pair exceeds the minimum reset discharge starting voltage $V_{MIN}$ ($-V_{MIN}$), so that priming particles are generated. By maintaining applying a voltage near the voltage $V_R$ ($-V_R$) in the second pulse voltage shift interval Tb for a predetermined period, a predetermined amount of wall charges are formed in each discharge cell. That is, by applying the minimum voltage ($V_{MIN}$, $-V_{MIN}$) which can cause the reset discharge to the discharge cells in the first pulse voltage shift interval Ta, the reset discharge of a low light emission luminance is caused. In the second pulse voltage shift interval Tb, the voltage to be applied to the discharge cells is immediately raised to the voltage $V_R'$ (decreased to the voltage $-V_R'$) at which the wall charges can be formed, and continuous application of the voltage is maintained. Therefore, the predetermined amount of wall charges is formed in a short period of time.

By the execution of the all-resetting step Rc, all of the discharge cells in the PDP 10 are initialized to the "light emitting cell" state where the light emission (sustaining discharge) is possible in the light emission sustaining step Ic, which will be explained hereinlater.

Figure 8:
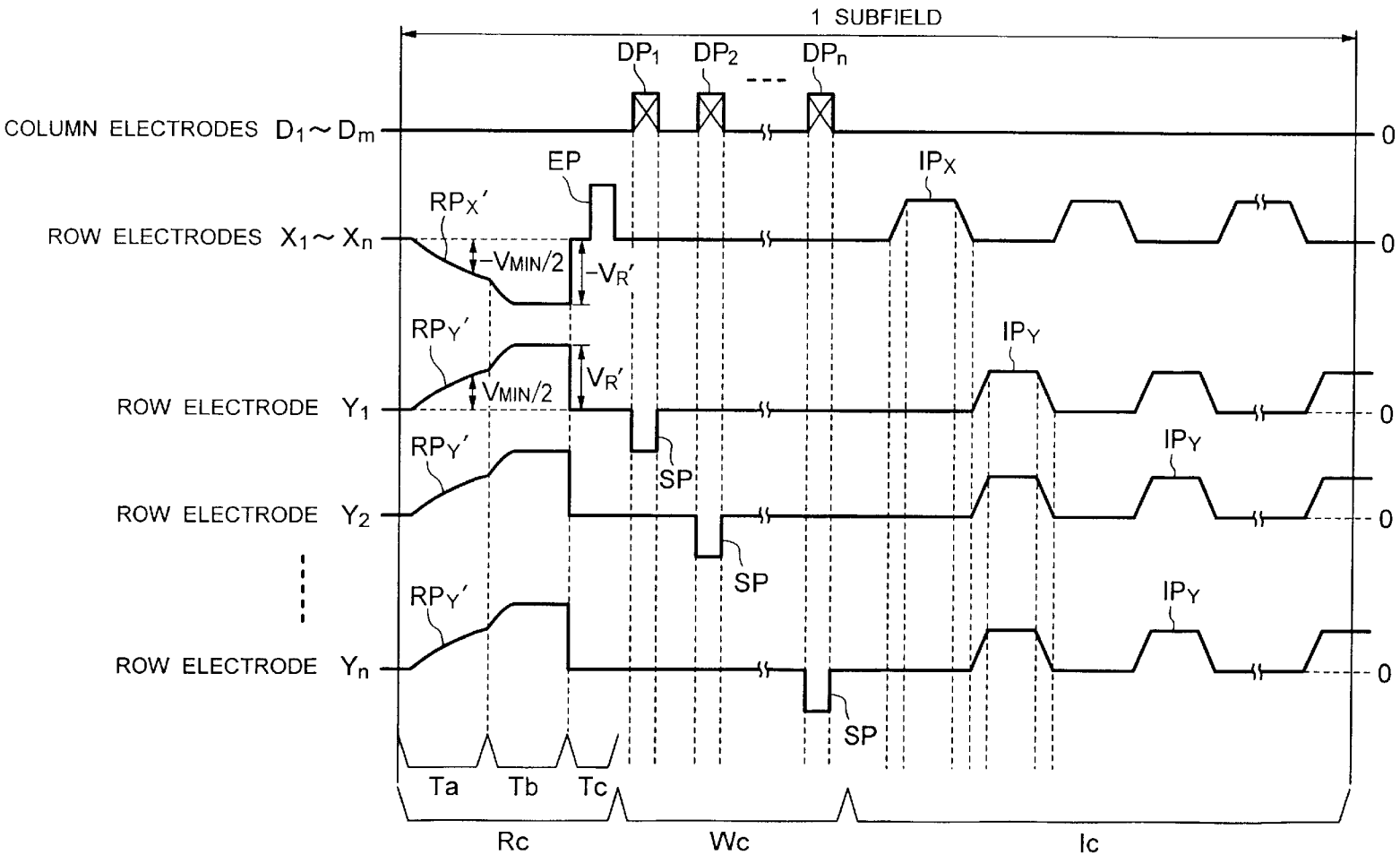
FIG. 8 is a diagram showing driving pulses in an all-resetting step and a pixel data writing step by a selective write address method and timing for applying those pulses.

In the case of using the selective write address method, as shown in FIG. 8, in the shift interval Tr, an erasing pulse EP whose polarity is opposite to that of the reset pulse $RP_X'$ and which is a short pulse is applied all at once to all of the row electrodes $X_1$ to $X_n$, thereby causing the discharge. By the generation of the discharge, the wall charges in all of the discharge cells are extinguished, and all of the discharge cells are initialized to the "non-light emitting" state.

Referring to FIG. 7 again, in the pixel data writing step Wc, the address driver 6 generates the pixel data pulse having the pulse voltage according to the pixel driving data bits DB supplied from the memory 3. In the subfield SF1, in response to each of the pixel driving data bits $DB1_{11}$ to $DB1_{nm}$, the address driver 6 generates the pixel data pulse which is set to the high voltage when the logic level of the data bit is equal to "1," and the low voltage (0 volt) when the logic level of the data bit is equal to "0". The address driver 6 sequentially applies the pixel data pulse groups $DP_1$ to $DP_n$, obtained by grouping the pixel data pulses every display line, to the column electrodes $D_1$ to $D_m$ as shown in FIG. 7.

During the above period of time, as shown in FIG. 7, the drive control circuit 4 sequentially supplies the switching signal SW21 at the logic level "0" and the switching signal SW22 at the logic level "1" to each of the scanning pulse generating circuit SY corresponding to each of the row electrodes $Y_1$ to $Y_n$ synchronously with the applying timing of each of the pixel data pulse groups $DP_1$ to $DP_n$. At this time, in the scanning pulse generating circuit SY to which the switching signals SW21 and SW22 are supplied, the switching device S22 is turned on and the switching device S21 is turned off. The scanning pulse SP of a negative polarity having a voltage $-V_h$ as shown in FIG. 7 is, thus, applied onto the row electrode Y corresponding to the scanning pulse generating circuit SY. At this time, a discharge (selective erasure discharge) is caused only in the discharge cell at the crossing portion of the display line to which the scanning pulse SP is applied, and the "column" to which the pixel data pulse of the high voltage has been applied. By the selective erasure discharge, the wall charges held in the discharge cell are extinguished, and the discharge cell is shifted to the "non-light emitting cell" state where the light emission (sustaining discharge) cannot be performed in the light emission sustaining step Ic, which will be explained hereinlater. The selective erasure discharge is not caused in the discharge cell to which the pixel data pulse of the low voltage has been applied although the scanning pulse SP was applied. The discharge cell, therefore, sustains the state where it was initialized in the all-resetting step Rc, that is, the "light emitting cell" state.

In the case of using the selective write address method, when the scanning pulse SP of the negative polarity is applied in the pixel data writing step Wc, a discharge (selective write discharge) is caused only in the discharge cell at the crossing portion of the display line to which the scanning pulse SP is applied and the "column" to which the pixel data pulse of the high voltage is applied. By the selective write discharge, the wall charges are induced in the discharge cell. The discharge cell is set to the "light emitting cell" which can perform the light emission (sustaining discharge) in the light emission sustaining step Ic, which will be explained hereinlater. The selective write discharge is not caused in the discharge cell to which the pixel data pulse of the low voltage is applied although the scanning pulse SP was applied. The discharge cell sustains the state where it was initialized in the all-resetting step Rc, that is, a state where there is no wall charge, and is set to the "non-light emitting cell".

That is, by the pixel data writing step Wc, even in the case of using either the selective erasure address method or the selective write address method, each of the discharge cells of the PDP 10 is set to either the "light emitting cell" state or the "non-light emitting cell" state in accordance with the pixel data based on the input video signal.

Subsequently, in the light emission sustaining step Ic, the drive control circuit 4 supplies each of the switching signals SW1 to SW4, which change as shown in FIG. 7, to the sustaining pulse generating circuit IX. Only the switching device S1 is first turned on by the above switching signals SW1 to SW4, and a current associated by the charges accumulated in the capacitor C1 flows into the discharge cell through the coil L1, diode D1, and row electrode X. The voltage on the row electrode X, thus, rises gradually as shown in FIG. 7. Subsequently, only the switching device S3 is turned on, and the voltage $V_{S1}$ generated from the DC power source B1 is immediately applied to the row electrode X. The voltage on the row electrode X, therefore, becomes the voltage $V_{S1}$ as shown in FIG. 7. Only the switching device S2 is subsequently turned on, and the current which is caused by the charges accumulated in the load capacitor C0 between the row electrodes X and Y flows into the capacitor C1 through the coil L2 and diode D2. The voltage on the row electrode X drops gradually as shown in FIG. 7. By repetitively executing the above operation as shown in FIG. 7, the sustaining pulse generating circuit IX repetitively applies the sustaining pulse $IP_X$ having the waveform as shown in FIG. 7 onto the row electrode X.

Further, in the light emission sustaining step Ic, the drive control circuit 4 supplies each of the switching signals SW11 to SW14 which change as shown in FIG. 7 to the sustaining pulse generating circuit IY. By the switching signals SW11 to SW14, only the switching device S11 is first turned on. The current associated by the charges accumulated in the capacitor C2, therefore, flows into the discharge cell through the coil L3, diode D3, line 12, switching device S15, line 20, switching device S21, and row electrode Y. The voltage on the row electrode Y rises gradually as shown in FIG. 7. Subsequently, only the switching device S13 is turned on, and the voltage $V_{S1}$ generated from the DC power source B3 is applied to the row electrode Y through the line 12, switching device S15, line 20, and switching device S21. The voltage on the row electrode Y becomes the voltage $V_{S1}$ as shown in FIG. 7. Subsequently, only the switching device S12 is turned on and the current associated by the charges accumulated in the capacitor C0 between the row electrodes X and Y flows into the capacitor C2 through the row electrode Y, switching device S21, line 20, switching device S15, coil L4, and diode D4. The voltage on the row electrode Y decreases gradually as shown in FIG. 7. By repetitively executing the operation as mentioned above as shown in FIG. 7, the sustaining pulse generating circuit IY repetitively applies the sustaining pulse $IP_Y$ having the waveform as shown in FIG. 7 to the row electrode Y.

That is, in the light emission sustaining step Ic, each of the X-row electrode driver 7 and the Y-row electrode driver 8 alternately repeats applying the sustaining pulse $IP_X$ of the positive polarity and the sustaining pulse $IP_y$ of the positive polarity as shown in FIG. 7 to the row electrodes $X_1$ to $X_n$ and the row electrodes $Y_1$ to $Y_n$. At this time, only the discharge cell in which the wall charges exist, that is, only the discharge cell in the "light emitting cell" state repeats a discharge (sustaining discharge) each time one of the sustaining pulses $IP_X$ and $IP_Y$ is applied. Therefore, the discharge cell repeats the light emission due to the discharge.

As mentioned above, only the discharge cell in which the wall charges formed by the reset discharge in the all-resetting step Rc remain without being erased even in the pixel data writing step Wc repeats light emission, and forms a display image in the light emission sustaining step Ic.

At this time, according to the invention, the reset pulses $RP_X'$ and $RP_Y'$ having the waveforms as shown in FIG. 7 are formed in order to cause the reset discharge in the all-resetting step Rc.

That is, in the first pulse voltage shift interval Ta in the reset pulses $RP_X'$ ($RP_Y'$), the voltage to be applied between the paired row electrodes X and Y is gradually dropped (raised) until it exceeds the minimum reset discharge starting voltage $-V_{MIN}$ ($V_{MIN}$) which can cause the reset discharge, thereby intermittently causing the reset discharge of low light emission luminance. In the next second pulse voltage shift interval Tb, the voltage is steeply dropped (raised), thereby shifting the voltage to a value near the lowest voltage $-V_R'$ (voltage $V_R'$) which can form the wall charges. By maintaining applying the voltage, the formation of a desired amount of wall charges is promoted.

Figure 1:
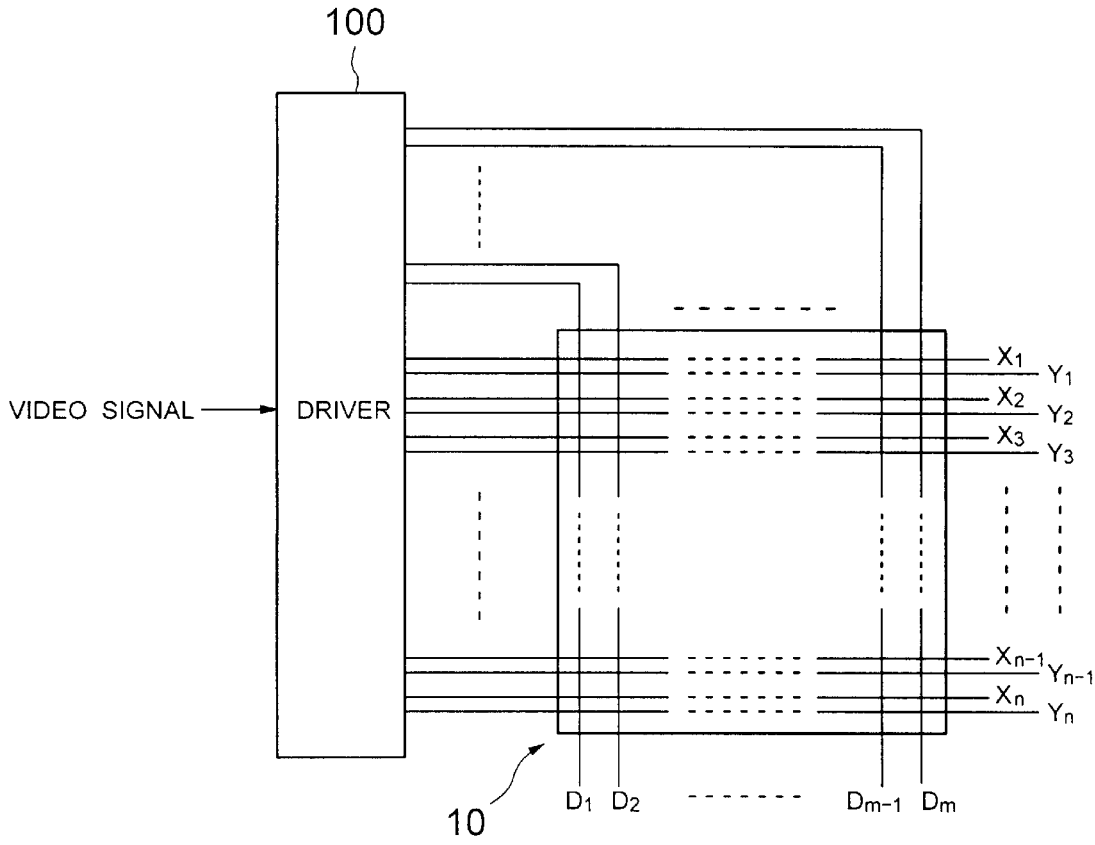
FIG. 1 is a diagram showing a schematic construction of a plasma display apparatus.
Figure 2:
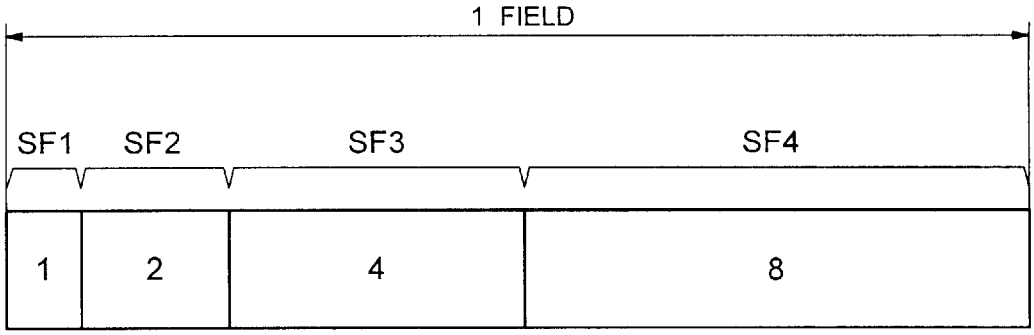
FIG. 2 is a diagram showing an example of a light emission driving format.
Figure 3:
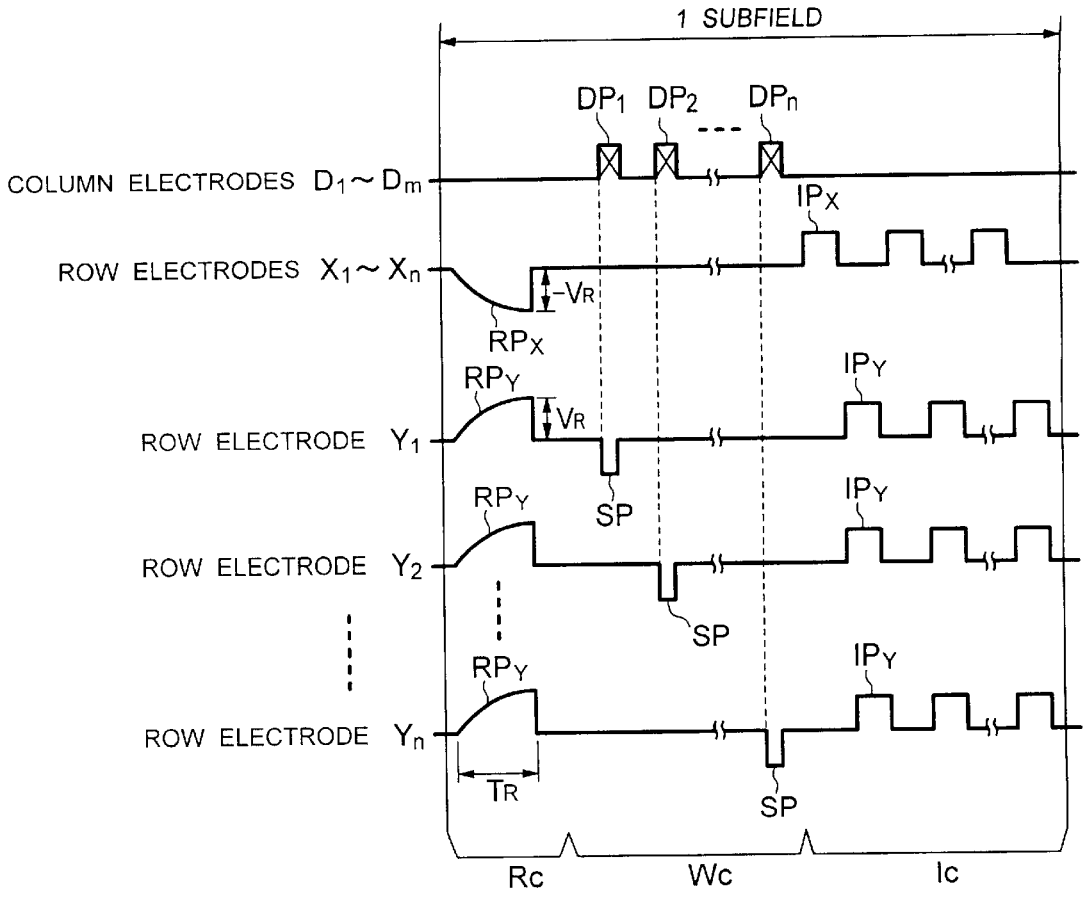
FIG. 3 is a diagram showing driving pulses which are applied to a PDP 10 in one subfield and timing for applying those pulses.

The desired amount of wall charges, consequently, can be formed even if the pulse width and voltage are set to be smaller than those of the conventional reset pulse RP having the waveform as shown in FIG. 3.

Figure 9:
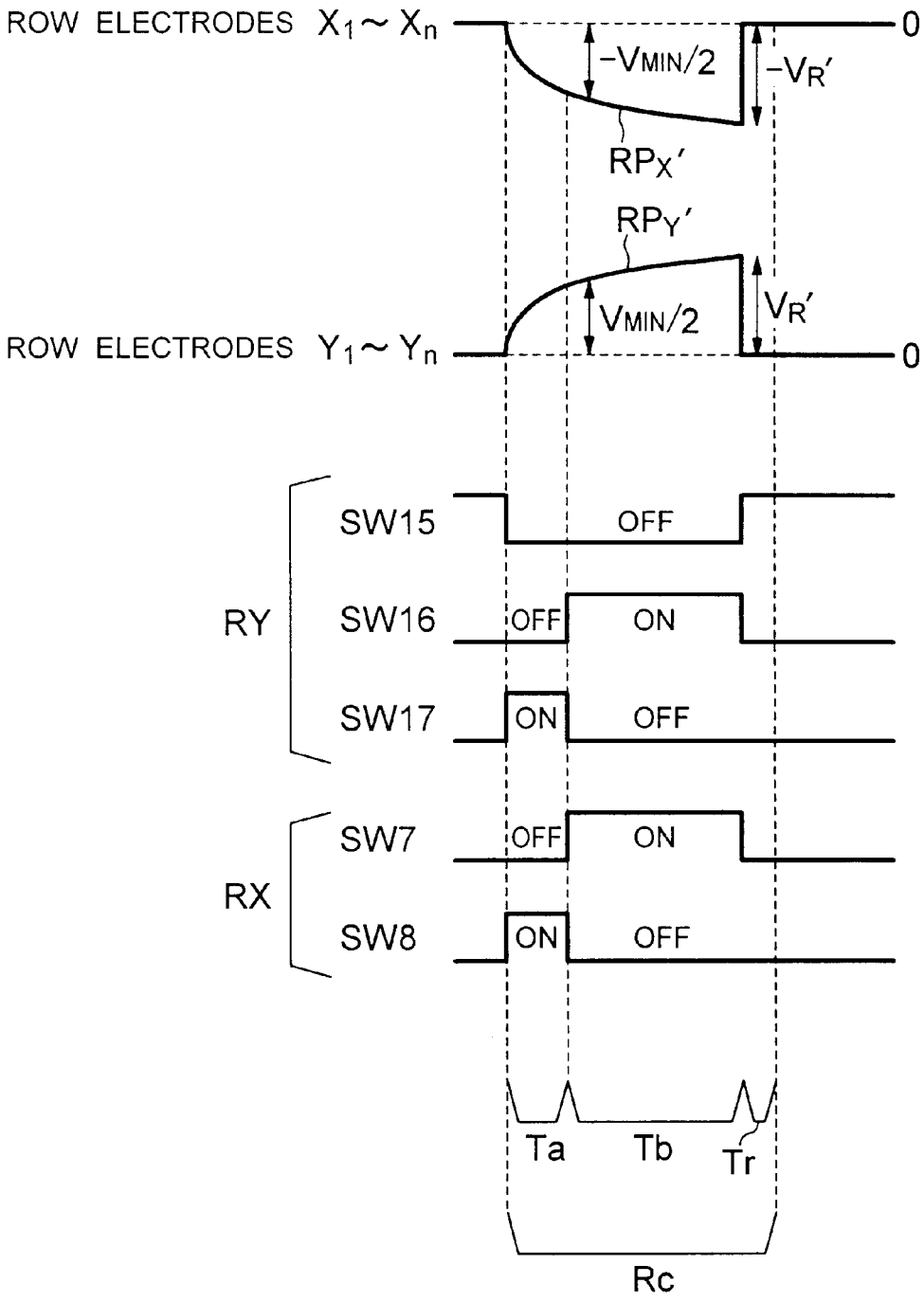
FIG. 9 is a diagram showing waveforms of another embodiment of a reset pulse RP'.

As waveforms of the reset pulses $RP_X'$ and $RP_Y'$, a similar effect can be obtained even if waveforms shown in FIG. 9 are used in place of those shown in FIG. 7.

In order to generate the reset pulses $RP^{X'}$ and $RP_Y'$ having the waveforms as shown in FIG. 9, the drive control circuit 4 supplies the switching signals SW7 and SW8 which change as shown in FIG. 9 to the reset pulse generating circuit RX. That is, the drive control circuit 4 first supplies the switching signal SW7 at the logic level "0" and the switching signal SW8 at the logic level "1" to the reset pulse generating circuit RX (the first pulse voltage shift interval Ta). Only the switching device S8 between the switching devices S7 and S8 is, then, turned on, thereby allowing the voltage $-V_R'$ as a negative side terminal voltage of the DC power source B2 to be applied to the row electrode X through the resistor R2. At this time, although the load capacitance C0 exists between the row electrodes X and Y, the voltage on the row electrode X steeply drops as shown in FIG. 9, since the resistor R2 has the relatively low resistance value as mentioned above. Before the voltage on the row electrode X decreases below the voltage of ½ of the minimum reset discharge starting voltage $-V_{MIN}$, the drive control circuit 4 switches the switching signal SW7 to the logic level "1", switches the switching signal SW8 to the logic level "0", and sustains those states for a time of 20 [μsec] or longer (the second pulse voltage shift interval Tb). Only the switching device S7 between the switching devices S7 and S8 is, thus, turned on in the second pulse voltage shift interval Tb, thereby allowing the voltage $-V_R'$ as a negative side terminal voltage of the DC power source B2 to be applied to the row electrode X through the resistor R1. Since the resistor R1 has a higher resistance value than that of the resistor R2 as mentioned above, the voltage on the row electrode X gradually drops as shown in FIG. 9 below the voltage of ½ of the minimum reset discharge starting voltage $-V_{MIN}$, and reaches the voltage $-V_R'$.

Further, in the all-resetting step Rc shown in FIG. 9, the drive control circuit 4 supplies the switching signals SW16 and SW17 which change as shown in FIG. 9 to the reset pulse generating circuit RY. That is, the drive control circuit 4 first supplies the switching signal SW16 at the logic level "0" and the switching signal SW17 at the logic level "1" to the reset pulse generating circuit RY (the first pulse voltage shift interval Ta). Only the switching device S17 between the switching devices S16 and S17 is, thus, turned on, thereby allowing the voltage $V_R'$ as a positive side terminal voltage of the DC power source B4 to be applied to the row electrode Y through the resistor R4, line 20, and switching device S21. At this time, although the load capacitance C0 exists between the row electrodes X and Y, the voltage on the row electrode Y steeply rises as shown in FIG. 9, since the resistor R4 has the relatively low resistance value as mentioned above. Before the voltage on the row electrode Y rises above the voltage of ½ of the minimum reset discharge starting voltage $V_{MIN}$, the drive control circuit 4 switches the switching signal SW16 to the logic level "1", switches the switching signal SW17 to the logic level "0", and sustains those states for a time of 20 [μsec] or longer (the second pulse voltage shift interval Tb). Only the switching device S16 between the switching devices S16 and S17 is, thus, turned on in the second pulse voltage shift interval Tb, thereby allowing the voltage $V_R'$ as a positive side terminal voltage of the DC power source B4 to be applied to the row electrode Y through the resistor R3, line 20, and switching device S21. At this time, since the resistor R3 has a higher resistance value than that of the resistor R4 as mentioned above, the voltage on the row electrode Y gradually rises as shown in FIG. 9 above the voltage of ½ of the minimum reset discharge starting voltage $V_{MIN}$, and reaches the voltage $V_R'$.

In the all-resetting step Rc, a period of time from the end of second pulse voltage shift interval Tb to the start of the pixel data writing step Wc is the shift interval Tr.

In accordance with the application of the reset pulses $RP_X'$ and $RP_Y'$ as shown in FIG. 9, in all of the discharge cells of the PDP 10, in the second pulse voltage shift interval Tb, a weak reset discharge is intermittently caused at the time when the voltage applied between the row electrodes X and Y exceeds the minimum reset discharge starting voltage $V_{MIN}$ ($-V_{MIN}$). By maintaining applying a voltage near the voltage $V_R$ ($-V_R$) in the second pulse voltage shift interval Tb for a predetermined period of time, a predetermined amount of wall charges are formed in each discharge cell.

According to the reset pulses $RP_X'$ and $RP_Y'$ shown in FIG. 9, by steeply changing the pulse voltage in the first pulse voltage shift interval Ta, a time which elapses until the voltage applied between the row electrodes X and Y reaches the minimum reset discharge starting voltage $V_{MIN}$ ($-V_{MIN}$) is set to be shorter than that of the reset pulse shown in FIG. 7. In the embodiment, as shown in FIGS. 7 and 9, a voltage shift state of the reset pulse RP' is switched at two stages in the all-resetting step Rc. It can be also similarly switched at three stages as shown in FIG. 10.

Figure 10:
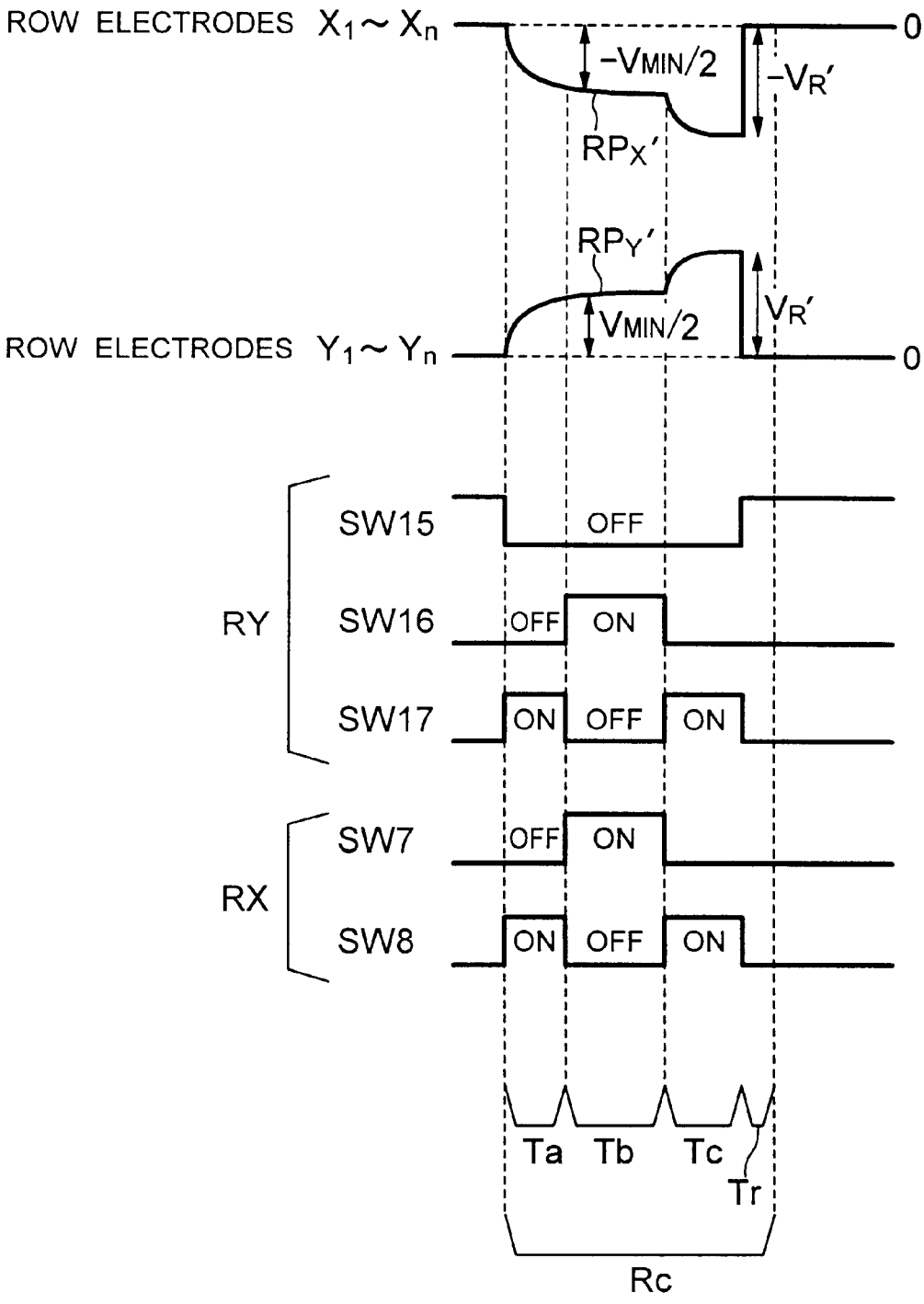
FIG. 10 is a diagram showing waveforms of further another embodiment of the reset pulse RP'.

In order to generate the reset pulses $RP_X'$ and $RP_Y'$ having waveforms as shown in FIG. 10, the drive control circuit 4 supplies the switching signals SW7 and SW8 which change as shown in FIG. 10 to the reset pulse generating circuit RX. That is, the drive control circuit 4 first supplies the switching signal SW7 at the logic level "0" and the switching signal SW8 at the logic level "1" to the reset pulse generating circuit RX (the first pulse voltage shift interval Ta). Only the switching device S8 between the switching devices S7 and S8 is, thus, turned on, thereby allowing the voltage $-V_R'$ as a negative side terminal voltage of the DC power source B2 to be applied to the row electrode X through the resistor R2. At this time, although the load capacitance C0 exists between the row electrodes X and Y, since the resistor R2 has the relatively low resistance value as mentioned above, the voltage on the row electrode X steeply drops as shown in FIG. 10. When the voltage on the row electrode X decreases to a value lower than the voltage of ½ of the minimum reset discharge starting voltage $-V_{MIN}$, the drive control circuit 4 switches the switching signal SW7 to the logic level "1", switches the switching signal SW8 to the logic level "0", and sustains those states for a time of 20 [μsec] or longer (the second pulse voltage shift interval Tb). Only the switching device S7 between the switching devices S7 and S8 is, thus, turned on in the second pulse voltage shift interval Tb, thereby allowing the voltage $-V_R'$ as a negative side terminal voltage of the DC power source B2 to be applied to the row electrode X through the resistor R1. At this time, since the resistor R1 has a higher resistance value than that of the resistor R2 as mentioned above, the voltage on the row electrode X gradually drops as shown in FIG. 10 to a value lower than the voltage of ½ of the minimum reset discharge starting voltage $-V_{MIN}$. Subsequently, the drive control circuit 4 again switches the switching signal SW7 to the logic level "0" and switches the switching signal SW8 to the logic level "1" (a third pulse voltage shift interval Tc). Only the switching device S8 is, thus, turned on again, thereby allowing the voltage $-V_R'$ as a negative side terminal voltage of the DC power source B2 to be applied to the row electrode X through the resistor R2. The voltage on the row electrode X, therefore, steeply drops as shown in FIG. 10 and reaches the voltage $-V_R'$.

Further, in the all-resetting step Rc shown in FIG. 10, the drive control circuit 4 supplies the switching signals SW16 and SW17 which change as shown in FIG. 10 to the reset pulse generating circuit RY. That is, the drive control circuit 4 first supplies the switching signal SW16 at the logic level "0" and the switching signal SW17 at the logic level "1" to the reset pulse generating circuit RY (the first pulse voltage shift interval Ta). Only the switching device S17 between the switching devices S16 and S17 is, thus, turned on, thereby allowing the voltage $V_R'$ as a positive side terminal voltage of the DC power source B4 to be applied to the row electrode Y through the resistor R4, line 20, and switching device S21. At this time, although the load capacitance C0 exists between the row electrodes X and Y, since the resistor R4 has the relatively low resistance value as mentioned above, the voltage on the row electrode Y steeply rises as shown in FIG. 10. When the voltage on the row electrode Y rises to a value near the voltage of ½ of the minimum reset discharge starting voltage $V_{MIN}$, the drive control circuit 4 switches the switching signal SW16 to the logic level "1", switches the switching signal SW17 to the logic level "0", and sustains those states for a time of 20 [μsec] or longer (the second pulse voltage shift interval Tb). Only the switching device S16 between the switching devices S16 and S17 is, therefore, turned on, thereby allowing the voltage $V_R'$ as a positive side terminal voltage of the DC power source B4 to be applied to the row electrode Y through the resistor R3, line 20, and switching device S21. At this time, since the resistor R3 has a higher resistance value than that of the resistor R4 as mentioned above, the voltage on the row electrode Y gradually rises as shown in FIG. 10. Subsequently, the drive control circuit 4 again switches the switching signal SW16 to the logic level "0" and switches the switching signal SW17 to the logic level "1" (the third pulse voltage shift interval Tc). Only the switching device S17 is, thus, turned on again, thereby allowing the voltage $V_R'$ as a positive side terminal voltage of the DC power source B4 to be applied to the row electrode Y through the resistor R4. The voltage on the row electrode Y, therefore, steeply rises as shown in FIG. 10 and reaches the voltage $V_R'$. In the all-resetting step Rc, a period of time from the end of the third pulse voltage shift interval Tc to the start of the pixel data writing step Wc becomes the shift interval Tr.

That is, in the reset pulses $RP_X'$ and $RP_Y'$ shown in FIG. 10, the voltage which is applied between the row electrodes X and Y serving as a pair steeply drops (rises) until timing just before it reaches the minimum reset discharge starting voltage $-V_{MIN}$ ($V_{MIN}$) (the first pulse voltage shift interval Ta). After that, the voltage gradually drops (rises), and the state is sustained for a predetermined time (20 [μsec]) or longer (the second pulse voltage shift interval Tb). At this time, in the second pulse voltage shift interval Tb, since the voltage which is applied between the row electrodes X and Y gradually exceeds the minimum reset discharge starting voltage $-V_{MIN}$ ($V_{MIN}$), a weak reset discharge is intermittently caused. After that, the voltage steeply drops (rises) again, and the voltage is shifted to the lowest voltage $-V_R'$ (voltage $V_R'$) at which the wall charges can be formed (the third pulse voltage shift interval Tc).

It is understood that the foregoing description and accompanying drawings set forth the preferred embodiments of the invention at the present time. Various modifications, additions and alternative designs will, of course, become apparent to those skilled in the art in light of the foregoing teachings without departing from the spirit and scope of the disclosed invention. Thus, it should be appreciated that the invention is not limited to the disclosed embodiments but may be practiced within the full scope of the appended claims.

This application is based on Japanese patent applications Nos. 2000-370988 and 2001-155217 which are hereby incorporated by reference.

What is claimed is:

1. A method for driving a plasma display panel in accordance with video signals, said plasma display panel including a plurality of discharge cells arranged in a matrix form, each of said discharge cells working as a display pixel, comprising the steps of:

applying a reset pulse to all of said discharge cells to cause all of said discharge cells to discharge for resetting all of said discharge cells;

applying a scanning pulse to each of said discharge cells to cause each of said discharge cells to selective-discharge for selecting either of light-emission and non-light-emission modes for each of said discharge cells on the basis of pixel data corresponding to a video signal for each of said discharge cells; and applying a sustaining pulse to allow only the discharge cell in the light-emission mode to discharge for repeating light emission, wherein said reset pulse comprises a first pulse voltage shift interval in which a pulse voltage changes gradually, reaches a minimum reset-discharge starting voltage, and exceeds the minimum reset-discharge starting voltage, and a second pulse voltage shift interval in which said pulse voltage changes steeply.

2. The method according to claim 1, wherein said first pulse voltage shift interval is more than or equal to 20 μsec.

3. A method for driving a plasma display panel in accordance with video signals, said plasma display panel including a plurality of discharge cells arranged in a matrix form, each of said discharge cells working as a display pixel, comprising the steps of:

applying a reset pulse to all of said discharge cells to cause all of said discharge cells to discharge for resetting all of said discharge cells;

applying a scanning pulse to each of said discharge cells to cause each of said discharge cells to selective-discharge for selecting either of light-emission and non-light-emission modes for each of said discharge cells on the basis of pixel data corresponding to a video signal for each of said discharge cells; and applying a sustaining pulse to allow only the discharge cell in the light-emission mode to discharge for repeating light emission, wherein said reset pulse comprises a first pulse voltage shift interval in which a pulse voltage changes steeply, and a second pulse voltage shift interval during which said pulse voltage changes gradually, reaches a minimum reset-discharge starting voltage, and exceeds the minimum reset-discharge starting voltage.

4. The method according to claim 3, wherein said second pulse voltage shift interval is more than or equal to 20 μsec.

5. A method for driving a plasma display panel in accordance with video signals, said plasma display panel including a plurality of discharge cells arranged in a matrix form, each of said discharge cells working as a display pixel, comprising the steps of:

applying a reset pulse to all of said discharge cells to cause all of said discharge cells to discharge for resetting all of said discharge cells;

applying a scanning pulse to each of said discharge cells to cause each of said discharge cells to selective-discharge for selecting either of light-emission and non-light-emission modes for each of said discharge cells on the basis of pixel data corresponding to a video signal for each of said discharge cells; and applying a sustaining pulse to allow only the discharge cell in the light-emission mode to discharge for repeating light emission, wherein said reset pulse comprises a first pulse voltage shift interval during which a pulse voltage changes steeply, a second pulse voltage shift interval during which said pulse voltage changes gradually, reaches a minimum reset-discharge starting voltage, and exceeds the minimum reset-discharge starting voltage, and a third pulse voltage shift interval during which said pulse voltage changes steeply.

6. The method according to claim 5, wherein said second pulse voltage shift interval is more than or equal to 20 μsec.

7. An apparatus for driving a plasma display panel in accordance with video signals, said plasma display panel comprising a plurality of discharge cells arranged in a matrix form, each of said discharge cells working as a display pixel, said apparatus further comprising:

a reset pulse generator for generating a reset pulse for causing each of said discharge cells to discharge and applying said reset pulse to all of said discharge cells, thereby resetting all of said discharge cells;

a scanning pulse generator for generating a scanning pulse for causing each of said discharge cells to selective-discharge for selecting either of light-emission and non-light emission modes for each of said discharge cells in accordance with pixel data corresponding to a video signal for said each of discharge cells, and applying said scanning pulse to said each of discharge cells; and a sustaining pulse generator for generating a sustaining pulse to allow only the discharge cell in the light-emission mode to discharge for repeating light emission, wherein said reset pulse comprises a first pulse voltage shift interval during which a pulse voltage changes gradually, reaches a minimum reset-discharge starting voltage, and exceeds said minimum reset-discharge starting voltage, and a second pulse voltage shift interval during which said pulse voltage changes steeply.

8. The apparatus according to claim 7, wherein said first pulse voltage shift interval is more than or equal to 20 μsec.

9. An apparatus for driving a plasma display panel in accordance with video signals, said plasma display panel comprising a plurality of discharge cells arranged in a matrix form, each of said discharge cells working as display pixels, said apparatus further comprising:

a reset pulse generator for generating a reset pulse for causing each of said discharge cells to discharge and applying said reset pulse to all of said discharge cells, thereby resetting all of said discharge cells;

a scanning pulse generator for generating a scanning pulse for causing each of said discharge cells to selective-discharge for selecting either of light-emission and non-light emission modes for each of said discharge cells in accordance with pixel data corresponding to a video signal for said each of discharge cells, and applying said scanning pulse to said each of discharge cells; and a sustaining pulse generator for generating a sustaining pulse to allow only the discharge cell in the light-emission mode to discharge for repeating light emission, wherein said reset pulse comprises a first pulse voltage shift interval during which a pulse voltage changes steeply, and a second pulse voltage shift interval during which said pulse voltage changes gradually, reaches a minimum reset-discharge starting voltage, and exceeds the minimum reset-discharge starting voltage.

10. The apparatus according to claim 9, wherein said second pulse voltage shift interval is more than or equal to 20 μsec.

11. An apparatus for driving a plasma display panel in accordance with video signals, said plasma display panel comprising a plurality of discharge cells arranged in a matrix form, each of said discharge cells working as a display pixel, said apparatus further comprising:

a reset pulse generator for generating a reset pulse for causing each of said discharge cells to discharge and applying said reset pulse to all of said discharge cells, thereby resetting all of said discharge cells;

a scanning pulse generator for generating a scanning pulse for causing each of said discharge cells to selective-discharge for selecting either of light-emission and non-light emission modes for each of said discharge cells in accordance with pixel data corresponding to a video signal for said each of discharge cells, and applying said scanning pulse to said each of discharge cells; and a sustaining pulse generator for generating a sustaining pulse to allow only the discharge cell in the light-emission mode to discharge for repeating light emission, wherein said reset pulse comprises a first pulse voltage shift interval during which a pulse voltage changes steeply, a second pulse voltage shift interval during which said pulse voltage changes gradually, reaches a minimum reset-discharge starting voltage, and exceeds said minimum reset-discharge starting voltage, and a third pulse voltage shift interval during which the pulse voltage changes steeply.

12. The apparatus according to claim 11, wherein said second pulse voltage shift interval is more than or equal to 20 $\mu$sec.

* * * * *